United States Patent [19]

Schaming

[11] Patent Number: 4,488,505

[45] Date of Patent: Dec. 18, 1984

[54] ELECTRONIC STRIP OILER

[75] Inventor: Edward J. Schaming, Butler, Pa.

[73] Assignee: Schaming Industries, Inc., Butler, Pa.

[21] Appl. No.: 494,284

[22] Filed: May 13, 1983

Related U.S. Application Data

[63] Continuation-in-part of Ser. No. 283,643, Jul. 15, 1981, Pat. No. 4,391,219.

[51] Int. Cl.[3] ..... B05B 5/02

[52] U.S. Cl. ..... 118/630; 118/313; 118/316; 118/325; 118/636; 239/553.3; 239/696; 239/708

[58] Field of Search ..... 118/621, 636, 325, 630, 118/315, 313; 239/553.3, 696, 708, 690; 427/420

[56] References Cited

U.S. PATENT DOCUMENTS

| | | | |
|---|---|---|---|
| 2,666,716 | 1/1954 | Kadell | 118/630 X |
| 3,402,695 | 9/1968 | Baker et al. | 118/315 X |
| 3,608,822 | 9/1971 | Berthoud | 118/629 X |

FOREIGN PATENT DOCUMENTS

| | | | |
|---|---|---|---|
| 1430231 | 3/1976 | United Kingdom | 118/315 |

*Primary Examiner*—Evan K. Lawrence
*Attorney, Agent, or Firm*—D. Paul Weaver

[57] ABSTRACT

Oil is delivered by a single pumping means to an application header which extends across the path of movement of an electrically grounded metal strip requiring oiling. A perforated plate within the header divides it into two chambers and forms a diffuser between the two chambers to assure an even distribution of oil in the chamber which receives its oil by passage through the diffuser. The perforated plate also forms a charging electrode for oil filling the header and serves a third purpose in that it is a final filter for the oil passing through the header. The header has oil delivery orifices or a continuous delivery slot leading from the chamber of the header which faces the metal strip. Oil is attracted in small discrete streams onto the surface of the grounded strip traveling in near proximity to the header and the strip is uniformly coated with oil across its full width. Excess oil is recovered and returned to the pumping means for recycling in the system. Optionally, external pressurized air sprays can be used to further disperse the small oil streams into a number of fine overlapping oil sprays across the width of the strip.

14 Claims, 10 Drawing Figures

FIG. 1
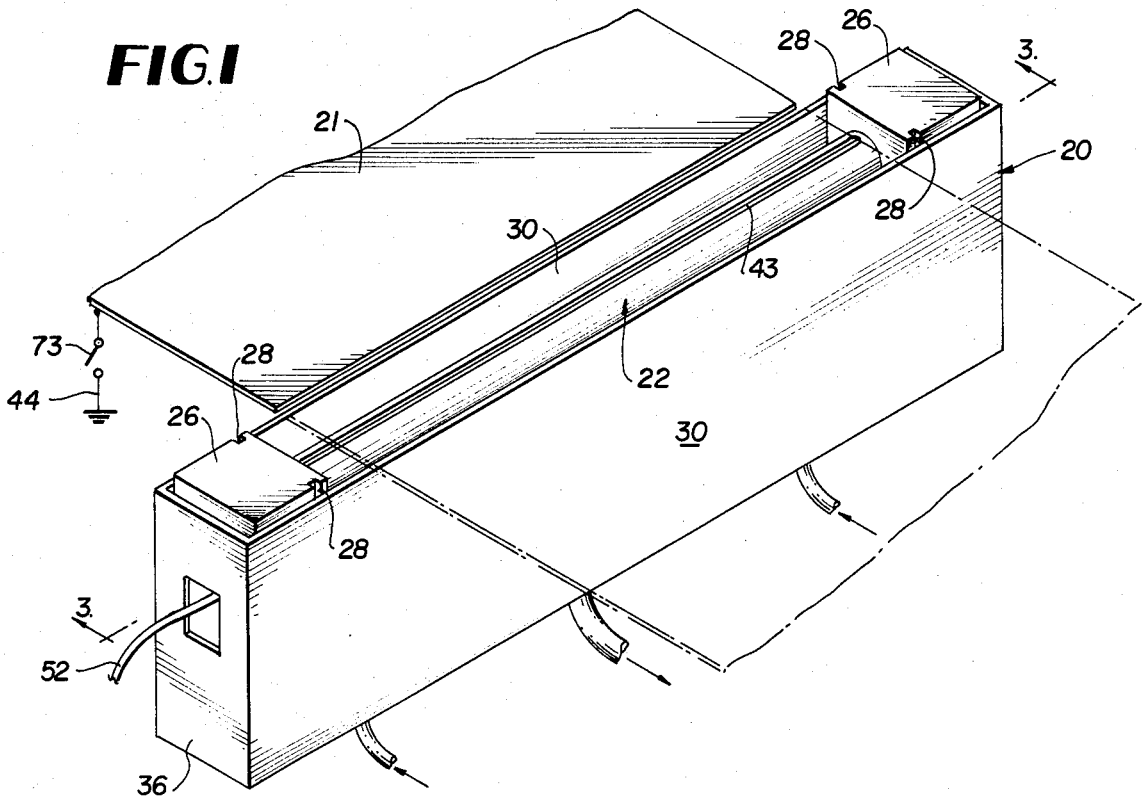
FIG. 2
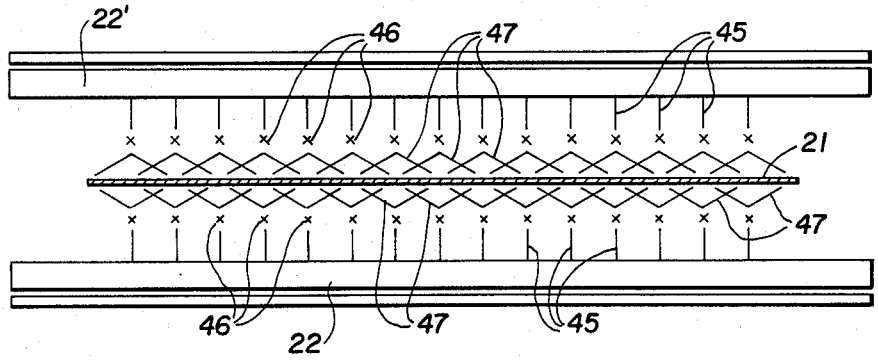
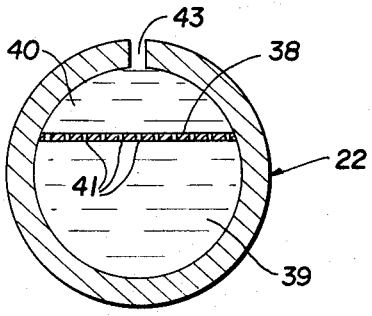
FIG. 7
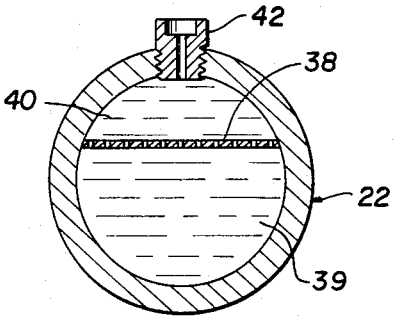
FIG. 6

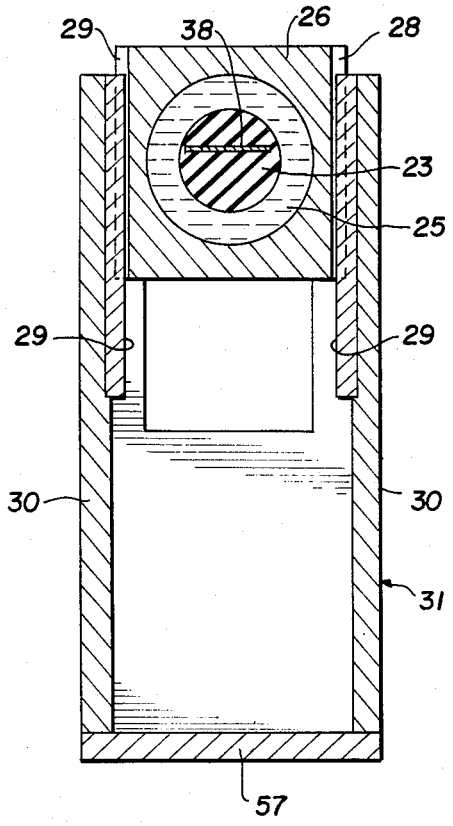
FIG. 8
FIG. 9
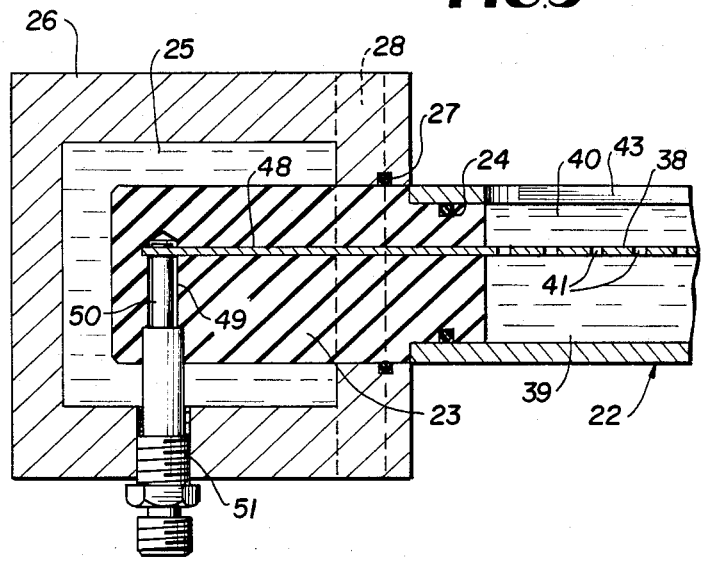
FIG. 10
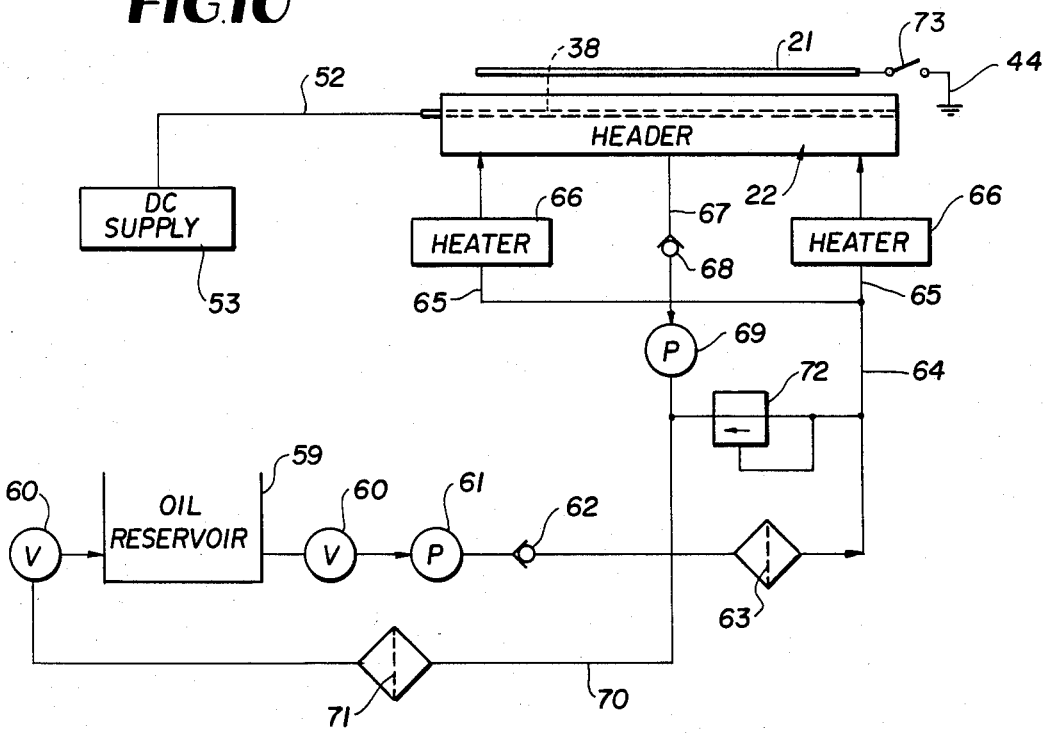

ELECTRONIC STRIP OILER

CROSS-REFERENCE TO RELATED APPLICATION

This application is a continuation-in-part of copending application Ser. No 283,643, filed July 15, 1981, for IONIC STRIP COATER AND METHOD, U.S. Pat. No. 4,391,219.

BACKGROUND OF THE INVENTION

The above prior application discloses an apparatus and method for oiling fast moving metal strips in rolling mills or the like. It is required that the strip be oiled uniformly across its entire width with the minimum possible consumption of oil and without polluting the surrounding environment. In the prior application, as in the present invention, oil is attracted to the moving strip, which is grounded, by electrostatic attraction. Under the effect of such attraction, small discrete streams of oil are pulled through outlet openings of an adjacent oil header and impinge on the opposing face of the moving strip to coat the same, with or without the assistance of external pressurized air sprays which disperse the small streams of oil into a number of fine overlapping oil sprays across the width of the strip.

A problem can arise with the arrangement disclosed in the prior application, and it is the main objective of this invention to eliminate this problem or drawback entirely even before it can arise. The problem in question arises when the header, which delivers oil by electrostatic attraction onto the moving metal strip, is not level and the oil within the header, for this reason or for other reasons, is not evenly distributed in the header along its full length. Even if the header is perfectly level, which condition is difficult to achieve and maintain, the oil within it still may not be evenly distributed due to inherent surging action in the pump system supplying the header with oil. Furthermore, there will always tend to be more oil in the header at the point or points where the oil enters the header under the influence of the pumping means. Even when plural pumps are used to deliver oil to several different inlets along the length of the header, completely even oil distribution is never attained. As a result of this unevenness of oil distribution in the header, some areas of the metal strip undergoing oiling will receive too much oil and other areas too little, with the final result that the strip will not be evenly oiled across its full width as desired. Also, the lack of even distribution of oil within the header will ultimately result in excessive consumption of oil by the oiling system.

As stated, the object of this invention is to deal with this prior art problem of oil distribution within the oiling header to enable even or uniform delivery of oil onto the strip across its full width with minimum oil consumption.

In achieving this main objective, a perforated oil diffuser plate is placed in the header dividing it into two chambers. A single pumping source delivers oil from a reservoir to one chamber of the header on one side of the diffuser plate, and the oil passes through the diffuser plate in order to enter and fill the other chamber of the header, and in so doing even distribution of oil within the second chamber of the header throughout its entire length is achieved and is easily maintained during continued operation of the system. Consequently, the strip being oiled which receives its oil by electrostatic attraction from the second chamber of the header in which the oil is evenly distributed is coated with oil uniformly across its entire width and a minimum volume of oil is consumed in the process.

Simultaneously, the perforated diffuser plate forms the charging electrode for the bath of oil filling the two chambers of the header in which the diffuser plate is submerged. Thirdly, the diffuser plate, by virtue of its relatively small aperture sizes, serves as a final filter for the oil passing through the header prior to delivery onto the metal strip.

In accordance with the invention, excess oil from the strip falls back into a recovery tank below the header and is efficiently returned from this tank back to the oil reservoir where it can be reused in the oiling system.

Consumption of oil, compared to the known prior art, is reduced by the invention by as much as fifty percent. The oil will be uniformly applied to the metal strip regardless of variations in strip speed. The entire strip oiling apparatus can be placed in a floor space of only about 1.5 feet lengthwise of the strip.

An important benefit and feature of the invention resides in the ability of the system to be turned off and on merely by throwing a switch in the electrostatic charging system. For example, when such switch is in one position, the moving metal strip may be grounded and will attract oil onto its surface facing the oiling header across its entire width. If the switch is in the other position, the ground circuit through the strip may be broken and consequently no oil will be attracted to the strip and the system is shut off entirely.

Furthermore, the system inherently possesses the capability of adjusting automatically to the width of the metal strip, whether wide or narrow, whenever the electrostatic system is on or energized. For example, if the strip being oiled extends substantially for the full length of the header, oil will be attracted from the header along its full length. If the strip happens to be very narrow, equalling only a small fraction of the header length, then the oil will be attracted only from that small region of the header across which the strip is moving. If the system is turned on electrically, whenever a strip of any width up to the maximum width which can be handled, the header will deliver oil by electrostatic attraction uniformly across the full width of the strip, and if no strip is present, no oil will leave the header as there will be nothing to attract the oil. Should there be areas on a moving strip which it is desired to coat with oil and other areas which are to remain uncoated, then the system can be rendered active or inactive, as desired, merely by the throwing of an on-off switch.

Other features and advantages of the invention will become apparent during the course of the following description.

BRIEF DESCRIPTION OF THE DRAWINGS

FIG. 1 is a fragmentary perspective view of an electronic strip oiler according to the present invention.

FIG. 2 is a schematic cross sectional view of the strip oiling system.

FIG. 6 is an enlarged vertical section taken on line 6—6 of FIG. 4.

FIG. 7 is a similar view taken on line 7—7 of FIG. 5.

FIG. 8 is a vertical section taken on line 8—8 of FIG. 3.

FIG. 9 is a vertical section taken through one end portion of the header and associated parts at right angles to FIG. 8.

FIG. 10 is a schematic view of the electrical and oil pumping systems for the apparatus.

DETAILED DESCRIPTION

Figure 3:
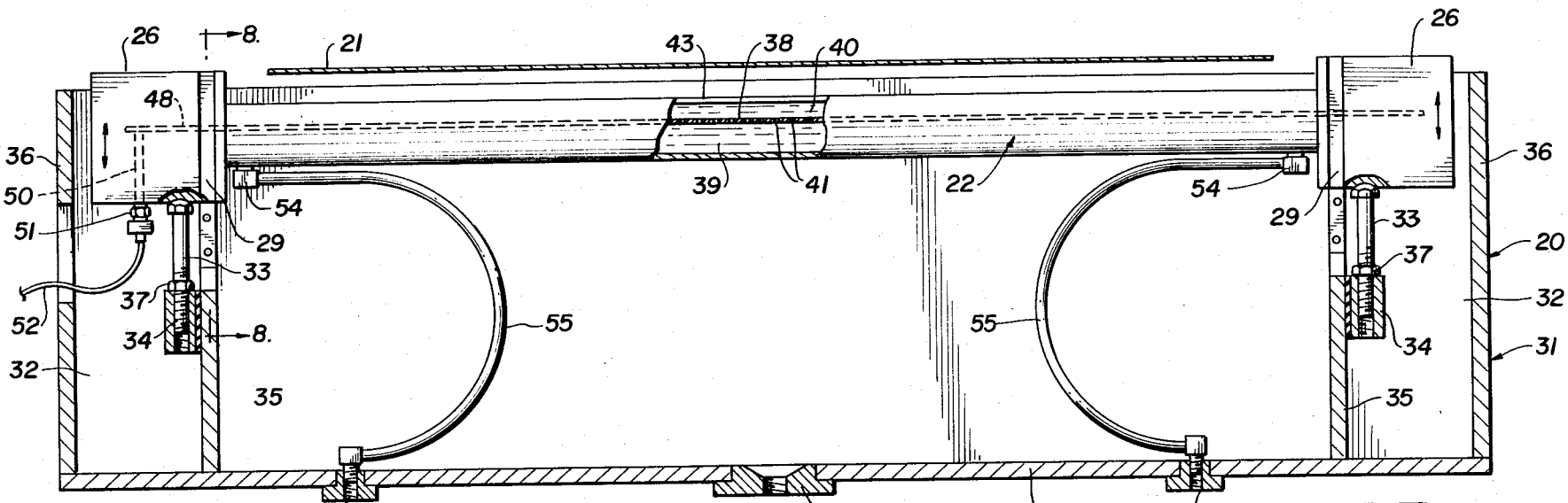
FIG. 3 is an enlarged transverse vertical section taken on line 3—3 of FIG. 1.

Referring to the drawings in detail wherein like numerals designate like parts, the numeral 20 designates an electronic strip oiler in its entirety for applying a coating of oil evenly to at least one surface of a moving metal strip 21 in a strip rolling mill or process line. The strip oiler 20 comprises a tubular header 22 which is metallic. The opposite ends of the header 22 receives therein telescopically heads or plugs 23 formed of electrical insulating material sealed by O-ring seals 24 within the opposite end portions of the header bore. The plugs 23 project into chambers 25 of opposite end mounting heads 26 and are further sealed with respect to the chambers 25 by O-ring seals 27, the chambers 25 being filled with oil.

The mounting heads 26, which are block-like, have vertical guide grooves 28 formed therein which receive vertical guide rails 29 fixed to the inner sides of the spaced vertical side walls 30 of an excess oil receiver tank 31.

The heads 26 are positioned in the upper portions of end chambers 32 of the tank 31 and are vertically adjustably held therein by adjusting screws 33 having threaded engagement with blocks 34 fixed to walls 35 of the tank 31 spaced inwardly from the tank end walls 36. The vertical axis adjusting screws 33 having locking nuts 37 thereon whereby the oil manifold 22 can be precisely adjusted vertically and leveled.

In accordance with a major aspect of the invention, a perforated metal oil diffuser plate 38 is fixed within the tubular header 22 parallel to the longitudinal axis of the header and dividing the header into two separated chambers 39 and 40, which are in communication through the multitude of evenly spaced perforations 41 of diffuser plate 38. The perforations 41 are spaced randomly over the entire area of the diffuser plate between the insulating plugs 23. While their size is not extremely critical, the perforations 41 are preferably in the range from 0.030" to 0.060".

As will be further discussed, oil from a pumping source enters the chamber 39 of header 22 and must pass through the perforations 41 in order to reach and fill the chamber 40. In so doing, the oil in chamber 40 is distributed equally along the entire length of the header 22 and is not concentrated at one or more points along the header in greater degree than at other points or regions.

Figure 4:
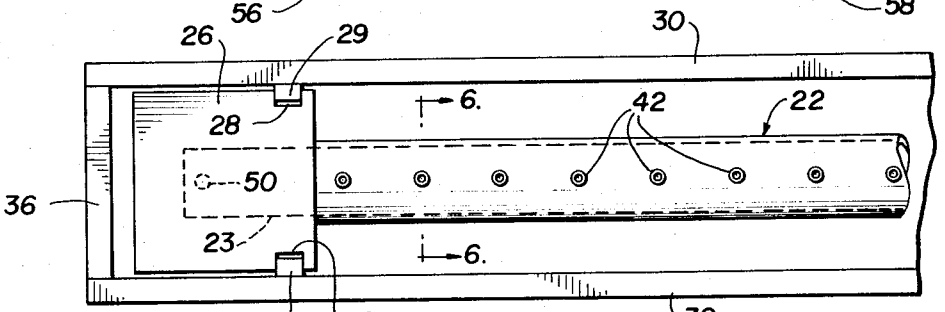
FIG. 4 is a fragmentary plan view of the apparatus wherein the oiling header has multiple spaced oil discharge orifices.
Figure 5:
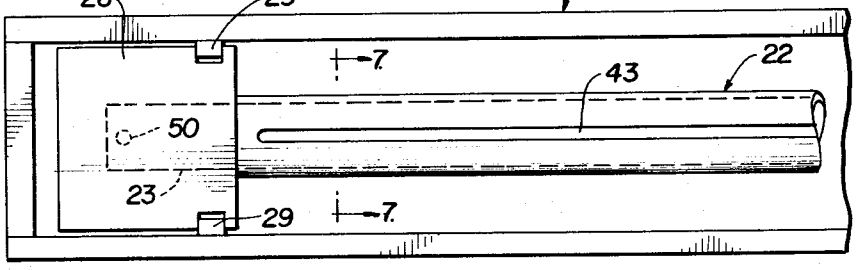
FIG. 5 is a similar view of the apparatus wherein the header has a continuous oil delivery slot.

Traveling above the header 22 in relatively closely spaced relationship thereto, regulated by the adjusting screws 33, is the fast moving metal strip 21 requiring oiling. The width of the strip 21 may vary from a wide strip, as shown in the drawings, spanning substantially the full length of the header to a much narrower strip spanning only a small fraction of the header length near the center of the apparatus. In any given case, oil for coating the adjacent surface of the strip 21 is delivered to the metal strip by electrostatic attraction through a series of equidistantly spaced orifice elements 42 fixed to the header, FIGS. 4 and 6, or in some cases through a continuous longitudinal oil delivery slot 43, FIGS. 3, 5 and 7 formed longitudinally through the header 22 at a location facing the surface of the strip 21 to be oiled. In either case, as the strip 21 passes across the oiling header 22 of the apparatus, oil from the chamber 40 is electrostatically attracted to the opposing face of the strip which is electrically grounded at 44 in a conventional manner, usually through the strip mill working rolls. The attracted oil passes through the continuous slot 43 or orifice elements 42 in the form of relatively small well defined streams which impinge upon the strip 21 to oil it in a uniform manner across the entire width of the strip.

As disclosed in the above-referenced prior application, it is desirable in some cases to act on the oil streams 45, FIG. 2, being delivered from the header 22 by means of external pressurized air sprays 46 while the streams are in flight between the header and strip 21, as disclosed in the prior application. When employed, the air sprays 46 will disperse the small discrete oil streams 45 into a multitude of overlapping fine oil sprays 47 across the entire width of the strip 21, on one or both sides of the strip depending upon requirements. As shown in FIG. 2, a somewhat modified header 22' for delivering coating oil to the top side of the strip 21 can be utilized when required, generally as disclosed in the prior application.

In addition to distributing the oil evenly in the chamber 40 along the entire length of the header 22, the perforated plate 38 also serves two additional important purposes in the apparatus simultaneously. One of these purposes of the perforated plate 38 is to act as a final filter for the oil just prior to its delivery onto the strip 21. Additionally, the plate 38 forms the electrode to impress a high voltage low amperage electrical charge on the body of oil filling the inside of the header 22 in both of its chambers 39 and 40, as discussed in the prior application.

In this latter connection, one end portion 48, FIG. 9, of the plate 38 is received in a slot of the adjacent insulating plug 23. This slot intersects the cross passage 49 within the plug 23 and in this cross passage is an electrical terminal 50 electrically connected with the plate end portion 48. The terminal 50 extends from a threaded fitting 51 received in a threaded opening of the adjacent mounting block 26. As shown in FIG. 3, a power supply cable 52 leads from a suitable DC power supply 53, FIG. 10, to the electrode 50, whereby the perforated plate 38 receives its high voltage charge which in turn charges the oil within the header.

The opposite end portions of the header 22 receive oil through two fittings 54 delivered from flexible hoses 55 connected with other fittings 56 held on the bottom wall 57 of the excess oil accumulating tank 20. The excess oil held by the tank 20 leaves the tank through a drain plug 58 on the tank bottom wall at the longitudinal center of the tank.

With reference to diagrammatic FIG. 10, oil from a reservoir 59 having upstream and downstream shut-off valves 60 is delivered to a single pump 61 by means of which the header 22 can be supplied, in contrast to some prior art arrangements which utilize several pumps in an effort to even out the supply of oil to the header 22 along its entire length. From the pump 61, the oil flows through a check valve 62 and through a filter 63 to a line 64 having parallel branches 65 leading to the two tank fittings 56, FIG. 3, and containing oil heaters 66. A return line 67 for oil in the tank 20 leads from the drain plug 58 to a check valve 68 and then to a return pump 69 which sends the oil back to the reservoir 59 through a return line 70 having a filter 71 connected therein. A pressure control valve 72 is connected between the lines 70 and 64 on the downstream side of pump 69, as shown.

The operation of the strip oiler can be summarized as follows. The apparatus is installed at least on one side of the strip 21 and the header 22 has its spacing from the strip and its levelness adjusted by means of the screws 33. The pump 61 is turned on and oil from the reservoir 59 is delivered to the header 22 through the two hoses 55 at both ends thereof to fill both chambers 39 and 40 of the header. The DC power supply 53 is also turned on to impress the high voltage charge on the plate 38 which charges the oil in the header 22 generally as described in the prior application. An on-off switch 73, which may be located in the grounding circuit for strip 21, is closed to complete the grounding of the strip which travels at high speed across the axis of the header 22. The presence of the grounded strip 21 across the header 22 causes oil from the chamber 40 to be propelled onto the opposing face of the strip 21 by electrostatic attraction as a plurality of spaced small oil streams 45, previously described, with or without the use of the external air sprays 46 depending upon needs.

In addition to charging the oil bath in the header 22 continuously, the perforated plate 38 diffuses the oil passing through the perforations 41 between chambers 39 and 40 and has the effect of causing almost perfect distribution of the oil within the chamber 40 along the full length of the header, without any noticeable concentration of oil in the regions of the fittings 54. Furthermore, the diffuser plate 38 serves to counteract any surging in the system caused by the supply pump 61, and its use enables a single pump to satisfactorily supply the header with oil, instead of multiple pumps used in some prior art systems in a somewhat futile effort to distribute the oil evenly along the length of the header.

In essence, the perforated diffuser plate 38 enables the application of oil evenly to the full width of the strip 21 without any gaps in the oil coating and without excessive oil application to the strip in local regions.

As explained, strips of different widths within the width range which the apparatus can accommodate will attract oil from the header 22 only in those regions along the header 22 where the strip 21 is present to attract oil electrostatically. In other words, the apparatus is automatic in adjusting to the width of the grounded strip and will not deliver oil elsewhere along the header. This results in a considerable saving of oil, and the oil recovery and recycling arrangement greatly minimizes overall oil consumption.

When it is desired to interrupt or restart the strip oiling process while the metal strip is moving, all that an operator need do is throw an on-off switch in the electrical system, as previously explained.

The apparatus is characterized by extreme simplicity, compactness, reliability and efficiency of operation, convenience of adjustment, low maintenance, and relative economy of manufacture.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An apparatus for coating a moving metal strip with oil or the like by electronic attraction comprising an oil delivery header at least on one side of the strip across the path of movement of the strip in spaced relationship thereto and having oil discharge outlet means, means for electrically grounding the moving metal strip, a perforated diffuser plate disposed within the header and dividing it longitudinally into two compartments which communicate only through the perforations of the diffuser plate, one of said compartments being in communication with said oil discharge outlet means, pumping means to deliver oil into the other compartment of the header, means to impress a high voltage low current electrical charge on the perforated diffuser plate to electrically charge a bath of oil substantially filling the compartments of the header within which the diffuser plate is submerged, and means to recover excess oil delivered from the oil discharge outlet means and return it to said pumping means for recycling in the apparatus.

2. An apparatus as defined in claim 1, wherein said means to impress a high voltage low current electrical charge comprises an electrical circuit, and further comprising an on off electrical switch in said circuit enabling the coating process to be turned off and on at will merely by throwing said switch.

3. An apparatus as defined in claim 1, and said oil discharge outlet means comprising a series of spaced orifices along the length of the header positioned to direct discrete streams of oil from the header onto a substantially opposing surface of the strip.

4. An apparatus as defined in claim 1, and said oil discharge outlet means comprising a continuous slot in the header longitudinally of the header and extending substantially for the length of the header and the full width of a metal strip of the maximum width which the apparatus can accommodate.

5. An apparatus as defined in claim 1, and said oil discharge outlet means being substantially opposite to and facing a surface of the moving strip traversing the header.

6. An apparatus as defined in claim 1, and said pumping means including a single pump for supplying oil to the header and being connected with the header at two opposite end portions thereof to deliver oil into said other compartment of the header.

7. An apparatus as defined in claim 1, and said means to recover excess oil comprising a recovery tank, and means connected with the recovery tank to transport oil therefrom to a reservoir upstream from the pumping means.

8. An apparatus as defined in claim 7, and the recovery tank serving as a support for said delivery header and means on said tank and operatively connected with said header to level the header and adjust its spacing from the metal strip.

9. An apparatus as defined in claim 8, and said last-named means comprising end mounting heads on the header, guideway means for the header on the header and recovery tank, and threaded adjusters on the tank engaging the end mounting heads.

10. An apparatus as defined in claim 1, and said means to impress a high voltage low current electrical charge on the perforated diffuser plate comprising a high voltage DC supply exteriorly of the header and including a supply cable having a terminal, an insulating body carried by one end of the header and having an opening receiving and enclosing an end portion of the perforated diffuser plate, the insulating body having another opening communicating with the first-named opening of the insulating body and receiving and enclosing said terminal of the DC power supply cable, and said terminal being electrically connected with the end portion of the perforated diffuser plate within the insulating body.

11. An apparatus for oiling a moving metal strip by electrostatic attraction comprising an oil delivery header at least on one side of the strip across the path of movement of the strip in spaced relationship thereto and having oil discharge opening means substantically facing an opposing surface of the strip, a perforated diffuser plate held within the header and dividing the header longitudinally into two compartments which communicate through the perforations of the diffuser plate, one of said compartments being in communication with the oil discharge opening means, means to deliver oil continuously to the other compartment of the header and to return excess oil to said delivery means, and electrical means to impress a high voltage low current charge on the perforated diffuser plate to charge the oil within the header within which the diffuser plate is immersed, said electrical means including a grounding circuit for the moving metal strip.

12. An apparatus as defined in claim 11, and adjusting means for said header to level it and to regulate the spacing of the header from the metal strip with precision.

13. An apparatus as defined in claim 11, and said electrical means including an insulator at least on one end of the header within which one end portion of the perforated diffuser plate is enclosed, and an external electrical power supply including a terminal electrically connected with said one end portion of the perforated diffuser plate within the insulator.

14. An apparatus as defined in claim 13, and another insulator on the other end of the header, and supporting means for the insulators and header.

* * * * *